US007062882B2

(12) United States Patent
Porat

(10) Patent No.: US 7,062,882 B2
(45) Date of Patent: Jun. 20, 2006

(54) ROOFING TILES

(76) Inventor: Ofer Porat, 3B Hagome St., Kiryat Tivon, 36090 (IL)

( * ) Notice: Subject to any disclaimer, the term of this patent is extended or adjusted under 35 U.S.C. 154(b) by 0 days.

(21) Appl. No.: 10/433,671

(22) PCT Filed: Dec. 7, 2001

(86) PCT No.: PCT/IL01/01134

§ 371 (c)(1),
(2), (4) Date: Jun. 5, 2003

(87) PCT Pub. No.: WO02/46549

PCT Pub. Date: Jun. 13, 2002

(65) Prior Publication Data

US 2004/0031222 A1 Feb. 19, 2004

Related U.S. Application Data

(60) Provisional application No. 60/251,843, filed on Dec. 8, 2000.

(51) Int. Cl.
*E04D 13/00* (2006.01)

(52) U.S. Cl. ..... 52/12; 52/15; 52/97

(58) Field of Classification Search ..... 52/12, 52/15, 97, 747.11, 748.1; 248/48.1
See application file for complete search history.

(56) References Cited

U.S. PATENT DOCUMENTS

| | | | |
|---|---|---|---|
| 4,010,577 | A | 3/1977 | Stalter |
| 5,584,147 | A | 12/1996 | Agee et al. |
| 6,151,837 | A | 11/2000 | Ealer, Sr. |
| 6,164,020 | A | 12/2000 | Nitch |
| 6,282,845 | B1 | 9/2001 | Hines |

FOREIGN PATENT DOCUMENTS

| | | | |
|---|---|---|---|
| DE | 3537163 | | 8/1986 |
| DE | 196 04321 | | 8/1997 |
| FR | 2701048 | * | 8/1994 |
| WO | WO9720118 | * | 11/1995 |
| WO | WO97/20118 | | 6/1997 |

* cited by examiner

*Primary Examiner*—Naoko Slack
(74) *Attorney, Agent, or Firm*—Mark M. Friedman

(57) ABSTRACT

An innovative roofing tile is presented, the roofing tile configured to allow liquid such as rain to flow through the roofing tile. The innovative roofing tile allows the design of a roof with ahidden gutters. Such a roof is both esthetic and allows for a low-maintenance and robust gutter system.

7 Claims, 12 Drawing Sheets

7A

7B

ROOFING TILES

This application is a 371 of PCT/IL01/01134 filed Dec. 7, 2001 which claims benefit of 60/251,843 filed Dec. 8, 2000.

FIELD AND BACKGROUND OF THE INVENTION

The present invention relates to an innovative roofing tile, a roof and a method for using the roofing tile in roofing a building, and more in particular to roofing tiles configured to direct precipitation to drain through the roofing tiles themselves.

Houses and other buildings are covered with roofs. One of the purposes of a roof is to direct precipitation away from the building of which the roof is part. In more primitive buildings or buildings in arid areas the roof simply shunts the precipitation onto the surrounding ground. More often, gutters (eave troughs) are placed around the peripheral edge of a pitched roof of a building. Precipitation falling on the roof rolls down the roof to the roof edge where it falls into a gutter. The gutter drains the water away to a specific location such as the local sewer system, a water reservoir or a nearby body of water. If not drained away, the accumulation of water around the base of a building can damage the building. Further, if the water is not drained away there is the inconvenience of having to access the building by wading.

The first disadvantage of gutters is that of esthetics. Gutters and the associated downspouts are an undesired visual addition to a building.

The second disadvantage is that gutters are usually fragile, yet are exposed to the elements, leading to high gutter wear.

In the winter, water in the gutter often freezes, damaging or destroying the gutter. Snow or debris that accumulates in and on the gutter or alternatively, icicles that hang from gutters can be of such weight that the gutters collapse or are bent out of shape.

During dry seasons, birds often nest in a gutter, forming an obstruction that prevents the normal flow of water. The result is overflow from the gutter during the rainy season. If the nest is transported to the drainage system, the drainage system is obstructed. Foreign objects such as a tennis ball or old sneakers may find their way into a gutter. Debris such as twigs, and especially the leaves of deciduous trees, falls in the gutter. If the gutter is not frequently cleaned, gutter overflow and obstruction is a serious problem. Small amounts of water lead to rotting of organic matter trapped in gutters, forming a foul smelling and dirty layer that is difficult and unpleasant to clean.

One solution for improving the appearance of a building is that removing the usual gutters and installing hidden gutters 10 in poured concrete buildings 12, FIG. 1. Downspouts and drains are integrated inside the walls or columns of the building. Hidden gutters 10 themselves are integrated behind fascia 14. Such hidden gutters have two primary disadvantages. First, fascia 14 partially obstructs the view of tiled roof 16, an esthetically undesirable result. Second, although massive and less prone to damage then standard gutters, poured concrete gutters are just as prone to obstruction by debris and foreign objects. A partial solution to overcome the esthetic disadvantage of hidden gutters is the addition of a course 18 of roofing tiles to the gutter limb, FIG. 2.

In the prior art, methods to prevent the entry of debris and solid objects into gutters have been described. A person may lay chicken wire or such over an exposed gutter. Although such an ad hoc solution prevents entry of large objects such as tennis balls, debris such as leaves and twigs are often trapped by the chicken wire which is then difficult to clean. Beyond being easily damaged, such solutions are exceptionally unesthetic.

Improvements of the "chicken wire method" are taught by U.S. Pat. No. 6,282,845, U.S. Pat. No. 6,164,020, U.S. Pat. No. 6,151,837 and others. In general, a device is provided to fit over existing gutter systems to prevent the entry of debris into the gutters.

U.S. Pat. No. 4,010,577 teaches of a system to replace a gutter system. Arrayed around the periphery of the roof of a building is an air duct with apertures. Water that arrives in the proximity of the apertures is blown away from the roof.

In order to prevent the problem of water freezing inside gutter downspouts, U.S. Pat. No. 5,584,147 teaches of a metal downspout that runs downwards inside the wall of a building and of a thermally insulated shroud to envelop any exposed portion of the downspout.

There is no roof drainage system described in the art that does not negatively influence the appearance of a building yet is robust, requires little maintenance and is not affected by obstructions or freezing.

SUMMARY OF THE INVENTION

The present invention provides an innovative roofing tile. The roofing tile is a "drain-through" roofing tile, that is one configured to allow liquid, such as rain water to pass through holes in the roofing tile itself. The use of the roofing tile of the present invention allows for the building of an esthetic roof with effective drainage. A water drainage system associated with a roof of the present invention is virtually unaffected by debris and large obstructions and is not damaged by freezing.

According to the teachings of the present invention there is provided a perforated roofing tile. Each perforated roofing tile has an upper surface and a lower surface. The upper surface is delimited at one extreme by a top edge and at another extreme by a bottom edge. Further, each roofing tile has at least one hole, the hole defining a passage for liquid flowing along the upper surface in a direction, the direction being from the top edge towards the bottom edge, so that the liquid flows through the hole or holes.

According to a feature of the present invention, each individual tile has one or more holes as described above. The holes of any individual tile can be of identical or different size. The size of each individual hole is dependent on many factors. If the hole is configured to accommodate an insert (see below) then the size and shape of the hole are selected accordingly. If the hole is configured to define a channel for liquid flow, the hole must be large enough to allow the effective flow of liquid, and small enough to prevent passage of objects that may obstruct the gutter or drainage system. As is clear to one skilled in the art, when the size of a hole is determined, the shape of the hole is also taken into account. A 1.5 cm wide by 20 cm long slot-shaped hole is likely to be an appropriate size whereas a 30 $cm^2$ circular hole may be considered too large.

A roofing tile of the present invention can be made of any appropriate material known in the art such as bitumen, concrete, laminated wood, plastic, metal or terra cotta. Method of producing a roofing tile of the present invention are dependent on the specific material from which the individual tile is fashioned.

According to an additional feature of the present invention, associated with each individual roofing tile is a mechanism or structural feature which causes liquid flowing through the at least one hole to fall from the roofing tile rather than to flow along the lower surface of the roofing tile.

Such a structural feature includes but is not limited to a protrusion on the lower surface of the roofing tile. In some cases such a structural feature is in contact with, adjacent to or in proximity of an edge of an individual hole. Such a structural feature is an integral part of the roofing tile or is attached to the roofing tile. When attached, the structural feature may be permanently or removably attached. Such a structural feature may be conveniently placed, at least partially within one of the holes in the tile. Other structural features include modifications of the shape of the tile, including shaping the lower surface of the tile so as to increase the tendency of liquid flowing through a hole in the tile to drop off from the tile, such as depressing the edge of a hole downwards.

According to an additional feature of the present invention, the upper surface of a roofing tile of the present invention is profiled so as to form one or more channels. The channel or channels are configured so that a liquid flowing along the upper surface of the roofing tile, in a direction from the top edge towards the bottom edge of the roofing tile, is directed by the channel or channels to the hole or holes.

According to an additional feature of the present invention, there is provided an insert. The insert is configured so as to fit into a hole in the roofing tile and partially obstruct it, with the aim of reducing the effective size of the hole and so to prevent the passage of large solid objects, or with the aim of directing liquid flowing through a hole to drop from the tile, or with the aim of directing liquid flowing along the upper surface of the roofing tile through a hole in the tile. The material from which the insert is fashioned can be the same or different from the material from which the roofing tile is fashioned.

According to an additional feature of the present invention, a roofing tile of the present invention is fashioned so as to be interleavable with other roofing tiles of the present invention.

Perforated roofing tiles have been described in U.S. Pat. No. 4,432,183, U.S. Pat. No. 5,159,975 and others. However, in these prior art, the perforations are substantially in parallel to the upper surface of the roofing tile and configured to act as weep holes to protect the roof undersurface from moisture accumulated under the roofing tile.

Individual roofing tiles with a hole passing from the upper surface to the lower surface of the roofing tile in order to allow the passage of a chimney or air duct through the tile are well-known in the art. In FIGS. 3A and 3B, two such roofing tiles, 20 and 22 respectively, manufactured by Laterizi Sereni S.p.A (Cremona, Italy) are illustrated. Hole 24 in roofing tiles 20 and 22 is configured to prevent the passage of water through hole 24 by the presence of a ridge 26. In addition, on upper surface 28 of tile 22 is fashioned channel 30 so that a liquid flowing along upper surface 28 in a direction from proximity with top edge 32 towards bottom edge 34 is directed away from hole 24.

There is also provided according to the teachings of the present invention a roof. The roof is made of at least one perforated roofing tile as described hereinabove and at most, the entire tiled surface of the roof is made with a perforated roofing tile as described hereinabove. The remaining tiled area of the roof is covered with prior art roofing tiles, arranged in the usual way so as to prevent the penetration of liquids through the roof.

According to a feature of the roof of the present invention, the perforated roofing tiles are attached to the roof, for example with the help of battens, in such a way that the upper edge of a perforated roofing tile is higher than the lower edge of a roofing tile and so that the upper surface of the roofing tile helps define the pitch of the roof.

According to a feature of the present invention, a roof of the present invention has one course comprising substantially only of perforated roofing tiles as described hereinabove, the course being in proximity of the edge of the roof so as to be able to drain away liquid from a significant proportion of the total tiled area of the roof.

According to a further feature of the present invention, all of the perforated roofing tiles of a given roof are arranged in one course, the course being in proximity of the edge of the roof so as to be able to drain away liquid from a significant proportion of the total tiled area of the roof.

According to a further feature of the present invention, the perforated roofing tiles of a given roof are arranged in proximity of each other, but not necessarily in the same or in a unique course of roofing tiles.

According to a still further feature of the roof of the present invention there is provided a mechanism (such as a gutter) to capture and transport liquid passing through a hole of a perforated roofing tile. When the perforated roofing tiles are arranged in a single course it is most convenient that the mechanism include a gutter, the gutter being positioned and of a dimension so that the liquid passing through a hole in a perforated roofing tile is captured within the gutter, wherefrom it is transported in the usual way.

As is clear to one skilled in the art, such a gutter is easily constructed as an integral part of the building itself, or can easily be hidden underneath, behind or within an additional construct such as a further course of roofing tiles or eaves of the roof. According to a further feature of the roof of the present invention, a gutter of the roof is hidden from view or is an integral part of the roof It is clear to one skilled in the art that drain pipes and such associated with the gutter are preferably also integrated within the building, for example within the walls of the building itself.

According to a feature of the roof of the present invention the perforated roofing tiles as well as other roofing tiles used in making a roof are mutually interleaved.

There is also provided according to the teachings of the present invention a method for constructing a roof, the method including: a providing a plurality of prior art roofing tiles; b. providing at least one perforated roofing tile as described hereinabove; c. arranging the prior art roofing tiles so as to prevent penetration of water through the roof where the prior art roofing tiles are arranged; and d. arranging the perforated roofing tile or tiles amongst the prior art roofing tiles so that the top edge of a perforated roofing tile is higher than the bottom edge of the same perforated roofing tile. Preferably the roofing tiles are arranged in courses.

According to a feature of the method of the present invention, all of the perforated tiles provided are arranged in one course of tiles.

According to a further feature of the method of the present invention, one course of tiles of the roof consists substantially entirely of perforated tiles.

According to a still further feature of the method of the present invention, a mechanism, such as a gutter is positioned in proximity of the perforated tiles of the roof so that liquid flowing through holes in the perforated roofing tiles is transported into the gutter.

The present invention addresses the shortcomings of known roof drainage systems. The roofing tiles of the present invention are lain on the roof in the usual manner of roofing tiles. Esthetically they are unobtrusive, resembling other roofing tiles. A roof made with the roofing tiles of the present invention does not need exposed, fragile and obstruction-susceptible prior art gutters, but gutters that are robust, protected from obstructions and can be made to be unobtrusive and esthetic.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
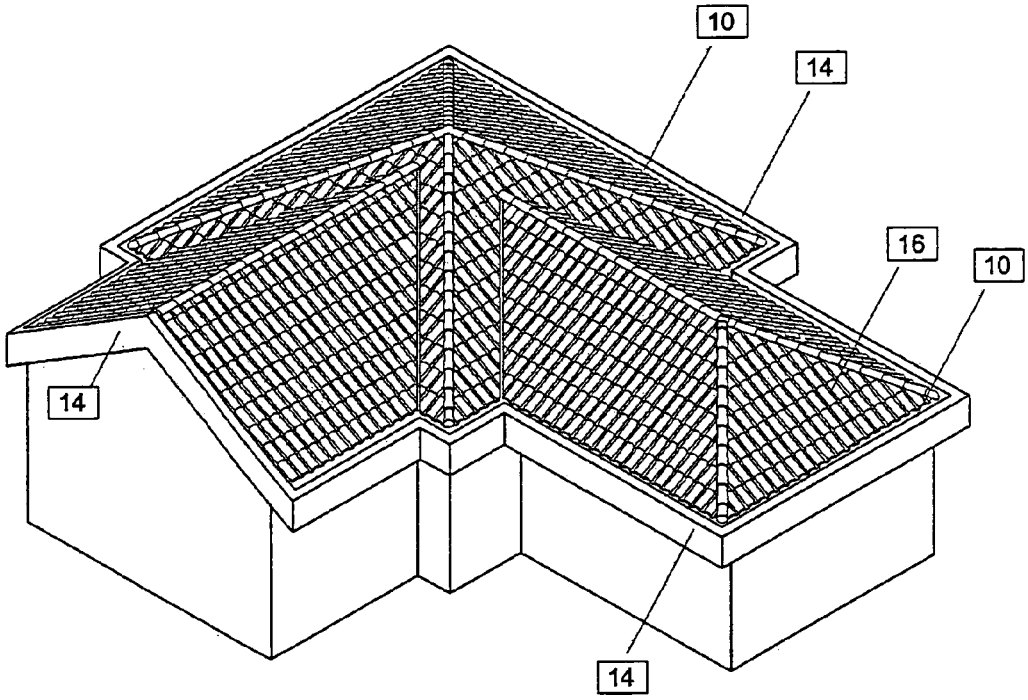
Figure 1 (Prior art)
FIG. 1 (prior art) is a depiction of a house with poured concrete hidden gutters.
Figure 2:
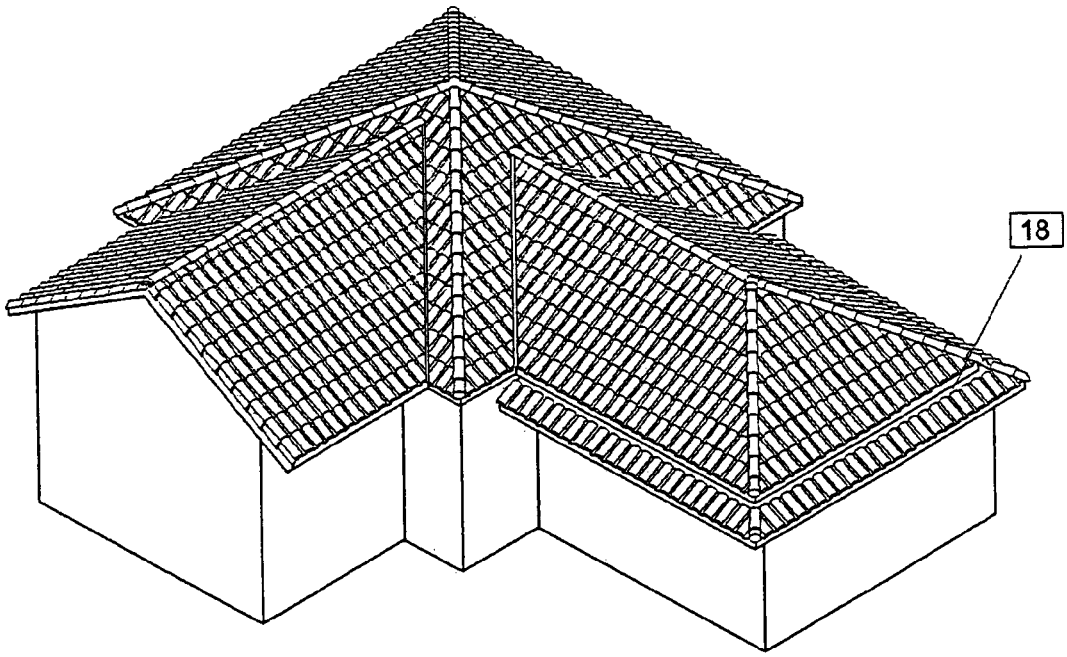
Figure 2 (Prior art)
FIG. 2 (prior art) is a depiction of a house with poured concrete hidden gutters and an additional course of roofing tiles added for esthetic reasons.
Figure 3B:
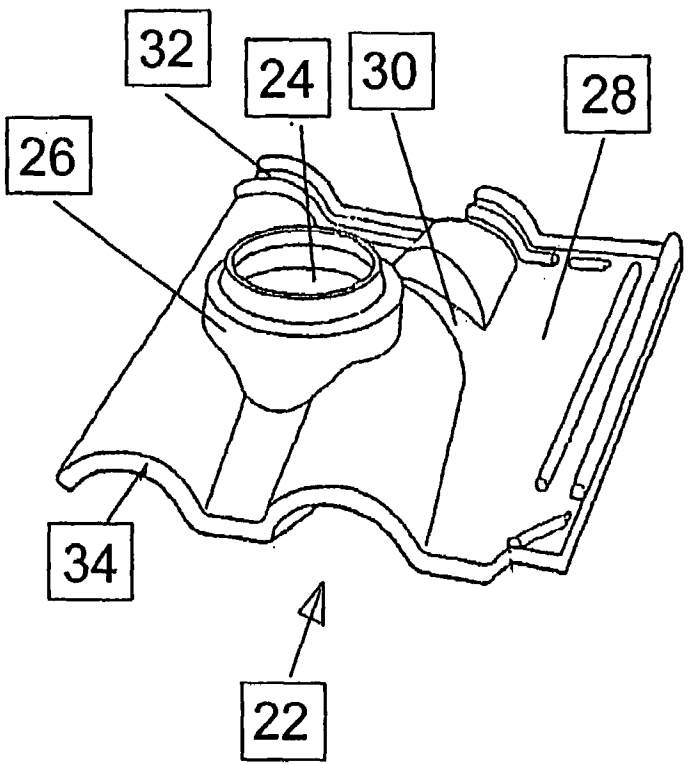
Figure 3B (prior art)
FIGS. 3A and 3B (prior art) illustrate prior art roofing tiles with a hole for a chimney or air vent.
Figure 3A:
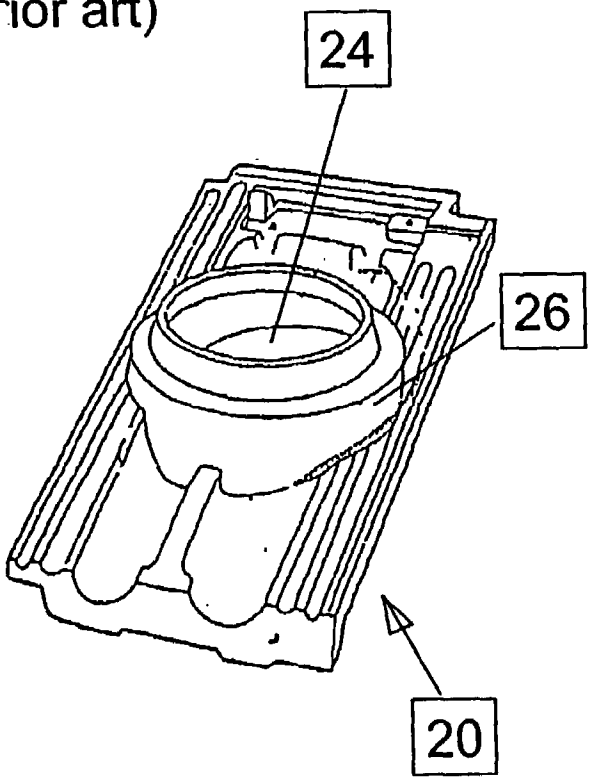
Figure 3A (prior art)

The present invention is of an innovative perforated roofing tile, of a roof and of a method of roofing a house. Specifically, the present invention is used to roof a building so robust low-maintenance gutters can be used without negatively influencing the appearance of a building roofed therewith.

The principle of use and manufacture of a perforated roofing tile according to the present invention may be better understood with reference to the drawings and the accompanying description. In the accompanying drawing like reference numerals refer to like parts throughout the figures.

Figure 4:
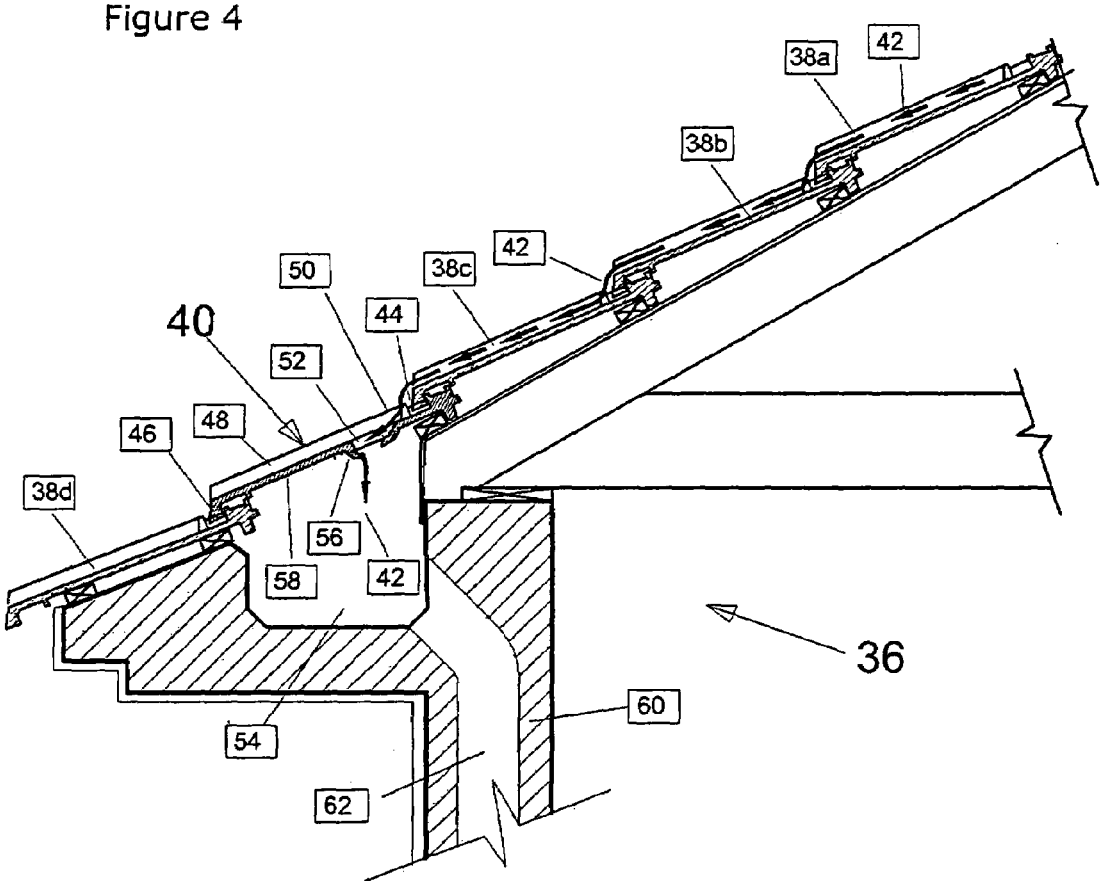
FIG. 4 is a side view of a roof constructed with a course of roofing tiles of the present invention.

Referring now to the drawings, FIG. 4 illustrates the general principle of use of a roofing tile 48 of the present invention as well as a roof 36 of the present invention. A side view of roof 36 is shown with four courses (38*a*, 38*b*, 38*c* and 38*d*) of prior art roofing tiles and one course, 40, of roofing tiles of the present invention. Liquid 42 flows downwards with the slope of roof 36, in a direction substantially from top edge 44 to bottom edge 46 of perforated roofing tile 48. Liquid 42 flows along upper surface 50 of roofing tile 48 until liquid 42 encounters hole 52. Liquid 42 flows through hole 52, and drops downwards into gutter 54, with the help of protrusion 56 attached to lower surface 58 of perforated roofing tile 48. Gutter 54 is built as an integral part of wall 60. Downspout 62 is built within wall 60.

Figure 5:
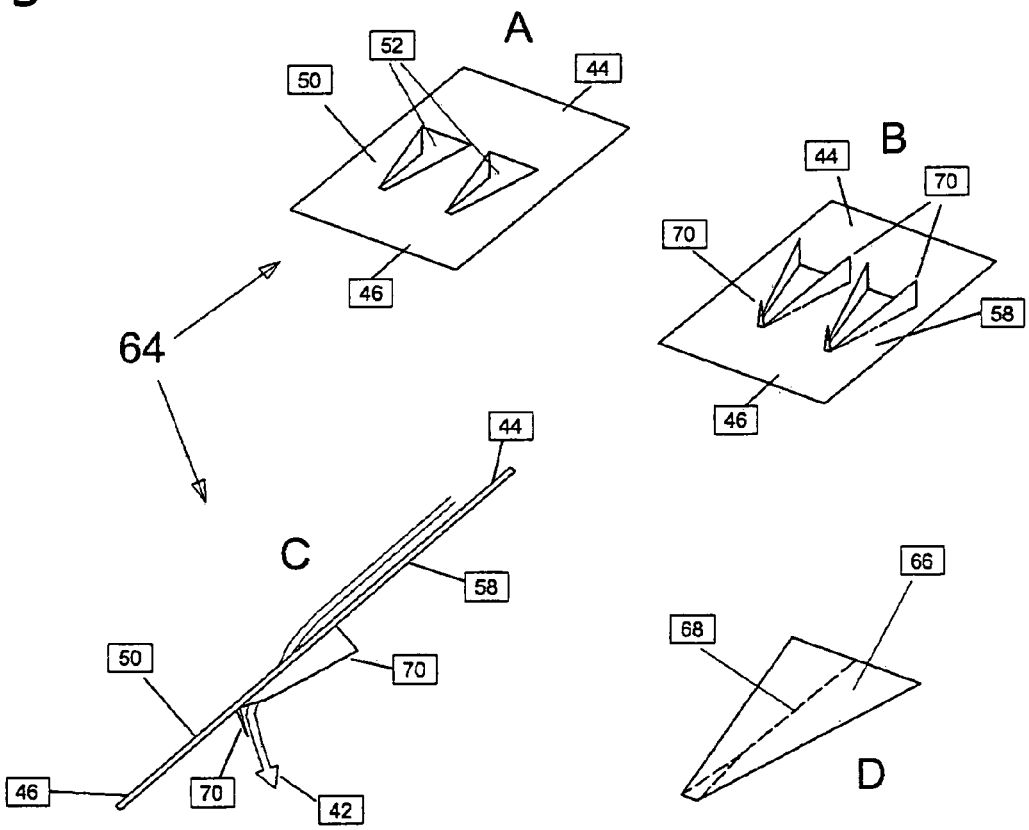
FIGS. 5A, 5B and 5C are a top, bottom and side view, respectively, of a first embodiment of a roofing tile of the present invention.
FIG. 5D is a detail of manufacture of a hole and a protrusion of the first embodiment of the roofing tile of the present invention

In a FIG. 5, a first embodiment of a perforated roofing tile of the present invention, 64, is depicted. Roofing tile 64 is depicted in a view from the top, FIG. 5A, from the bottom, FIG. 5B, and from the side, FIG. 5C. Tile 64 has an upper surface 50, a lower surface 58, a top edge 44, a bottom edge 46 and two holes 52. Roofing tile 64 is made of sheet metal such as galvanized iron, stainless steel, tin, copper or lead by stamping. Simultaneously with the stamping out of tile 64 itself from a large sheet of metal, holes 52 are stamped-out. Although in some embodiments it is chosen that the stamped-out sections corresponding to holes 52 be completely detached, in tile 64 the stamped out sections 66 are cut as indicated by dotted lines 68 in FIG. 5D, and bent to form protrusion 70.

In FIG. 5C, liquid 42 flows along upper surface 50 of tile 64 in a general direction defined from top edge 44 towards bottom edge 46. When encountering holes 52, liquid 42 flows through holes 52. Liquid 42 follows protrusions 70 to the tip of protrusions 70, dropping downwards therefrom. As described hereinabove, in some embodiments of the present invention, mechanisms or features such as protrusions 70 are useful in guiding liquid 42 flowing through holes 52 away from bottom edge 58 of tile 64, as depicted in FIG. 5C.

A protrusion such as 70 can be an integral part of a roofing tile of the present invention, can be reversibly attached or irreversibly attached to the roofing tile. A protrusion such as 70 can be located in the proximity of an edge of a hole of the roofing tile or at some distance therefrom.

Figure 6:
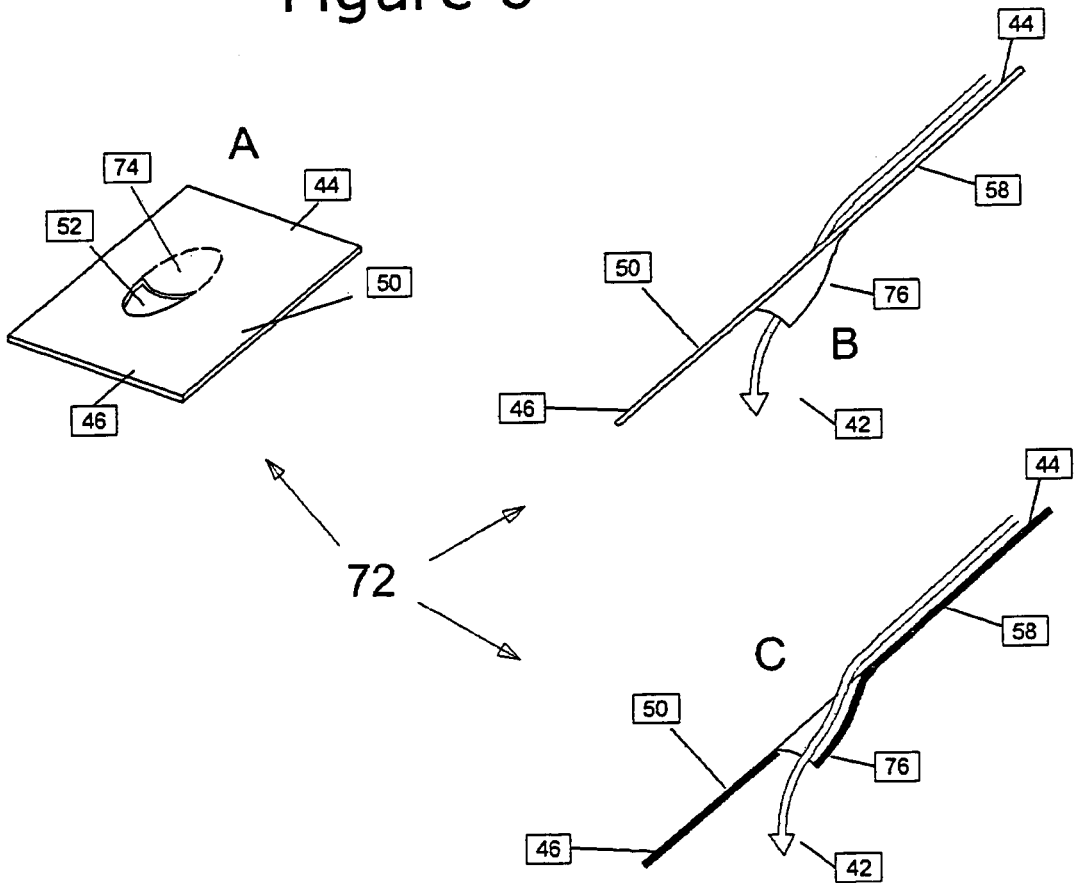
FIGS. 6A, 6B and 6C are a top, side and side cross-section view, respectively, of a second embodiment of a roofing tile of the present invention.

As is clear to one skilled in the art, it is possible to supply a mechanism for guiding liquid flowing through the hole away from lower surface of roofing tile of the present invention which is not a protrusion. For example, as in a second embodiment of a roofing tile of the present invention, 72 depicted in a view from the top, FIG. 6A, from the side, FIG. 6B, and from the side in cross section, FIG. 6C. Tile 72 has a upper surface 50, a lower surface 58, a top edge 44, a bottom edge 46 and a hole 52. Tile 72 is made of a sheet metal such as galvanized iron, stainless steel, tin, copper or lead by stamping the outer form. Simultaneously with the stamping out of tile 72 itself from a large sheet of metal, hole 52 can be stamped out and disconnected from the rest of tile 72. Simultaneously or subsequently, area 74 can be deformed downwards relative to upper surface 50 to form spout 76. As depicted in FIG. 6B, liquid 42 flows along upper surface 50 of tile 72 in a direction from top edge 44 towards bottom edge 46. Liquid 42 flows through hole 52. Liquid 42 is guided by spout 76 to drops downwards from tile 72, as depicted in FIG. 6B.

The draining capacity of an individual tile of the present invention is dependent on such factors as the total area of the hole or holes, and to a lesser extent, the shape and arrangement of the hole or holes. The holes of any individual tile can be of the same or of different sizes and shapes. In general, the greater the total area of the hole or holes, the greater the draining capacity of the tile. If an individual hole is large the chance of debris entering the gutter and drainage system increases. The selection and design of the number, size and arrangement of holes in an individual tile is a function of the expected rate of precipitation, area of the roof to be drained, slope of the roof, the nature of the debris expected and esthetic factors. This selection and design is well within the capabilities of one of average skill in the art, and is not limiting to the scope of the present invention.

Figure 7:
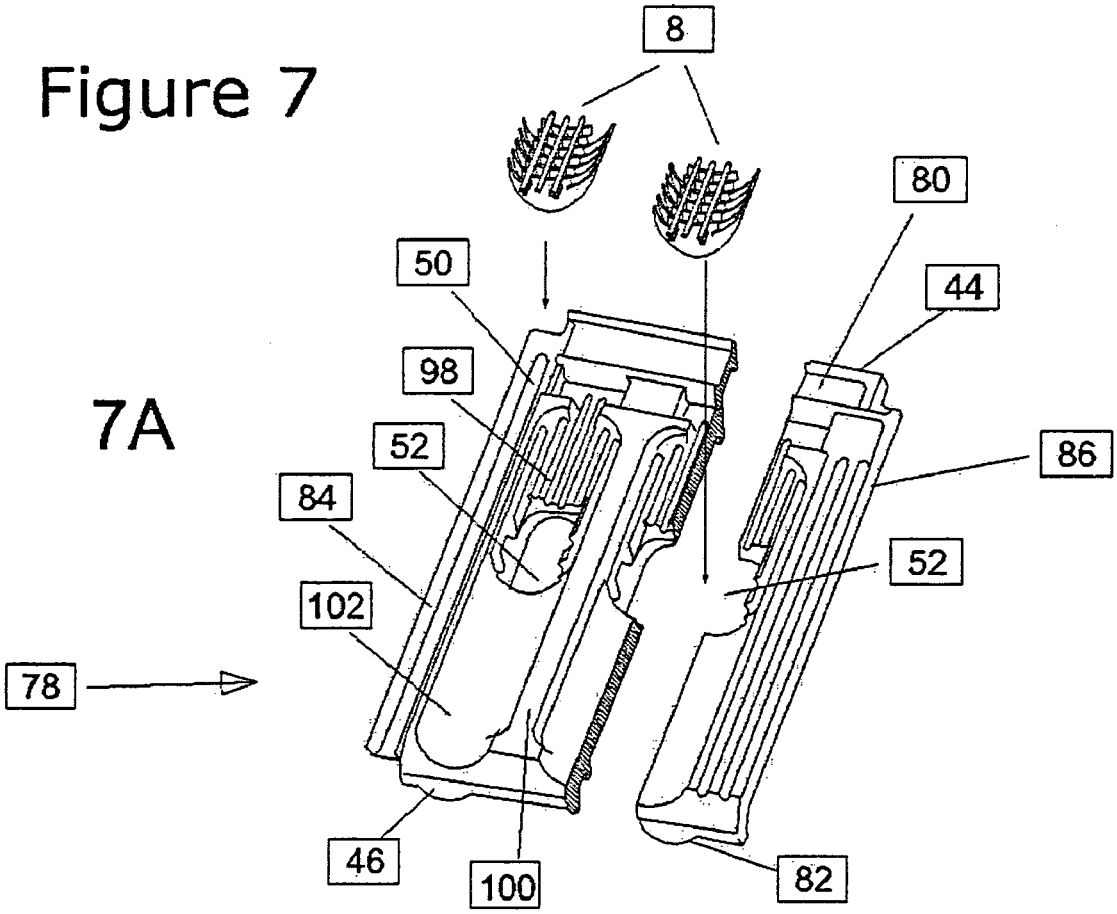
FIG. 7A is a top view of a third embodiment of the roofing tile of the present invention, the roofing tile having a removable plastic insert.
FIG. 7B is a top view of the third embodiment of the present invention where the plastic insert is depicted inside the hole of the roofing tile.
Figure 7:
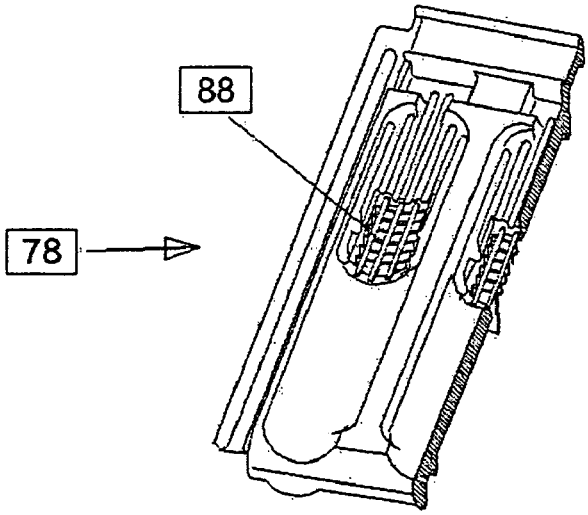

In FIG. 7, an additional embodiment of a roofing tile of the present invention, 78, is depicted from a top view. In proximity of top edge 44 on upper surface 50 is found first groove 80. In proximity of bottom edge 46 on lower surface 58 is found first ridge 82. The dimensions of first ridge 82 and first groove 80 are such that first ridge 82 can fit inside first groove 80. On upper surface 50 on one side of tile 78 is found second groove 84. On lower surface 58 on the side opposing second groove 84 is a second ridge 86. The dimensions of second ridge 86 and second groove 84 are such that second ridge 86 can fit inside second groove 84. As is clear to one skilled in the art, ridge 86 and groove 84 allow tile 78 to interleave with other tiles 78 in a same course when installed on a roof. Further, groove 80 and ridge 82 allow tile 78 to interleave with tiles found in courses above and below the course in which tile 78 is found.

Holes 52 of roofing tile 78 are relatively large. To prevent passage of debris through holes 52, inserts 88 are set in holes 52, as depicted in FIG. 7B. If inserts 88 are damaged, inserts 88 are easily removed and replaced.

Figure 8:
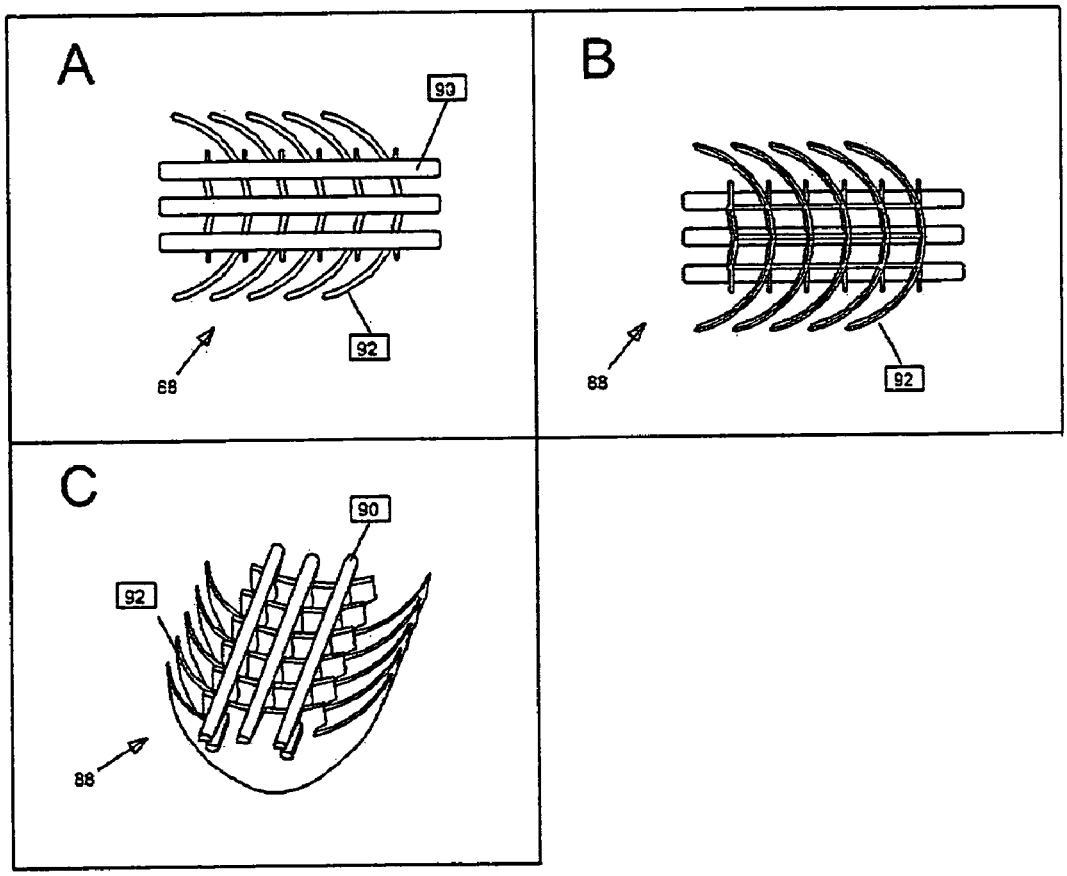
FIGS. 8A, 8B and 8C are a top, bottom and perspective view, respectively, of a plastic insert for a roofing tile of the present invention.

Insert 88 is depicted in greater detail in FIG. 8. The passages for liquid flow defined by straight ribs 90 and curved ribs 92 of inserts 88, seen from the top in FIG. 8A, from the bottom in FIG. 8B and in perspective in FIG. 8C are relatively small. Thus, debris cannot pass through the passages. As is clear to one skilled in the art, curved ribs 92 also function to direct liquid passing through a hole 52 wherein an insert 88 is installed (FIG. 7B) downwards from lower surface 58 of roofing tile 78.

Insert 88 is most easily manufactured from a plastic material. Tile 78 is advantageously manufactured in a mold from clay, terra cotta or concrete. Holes 52 are defined in the wet material of roofing tile 78 when still in the mold and the resulting plugs are removed after a hardening step.

Figure 9:
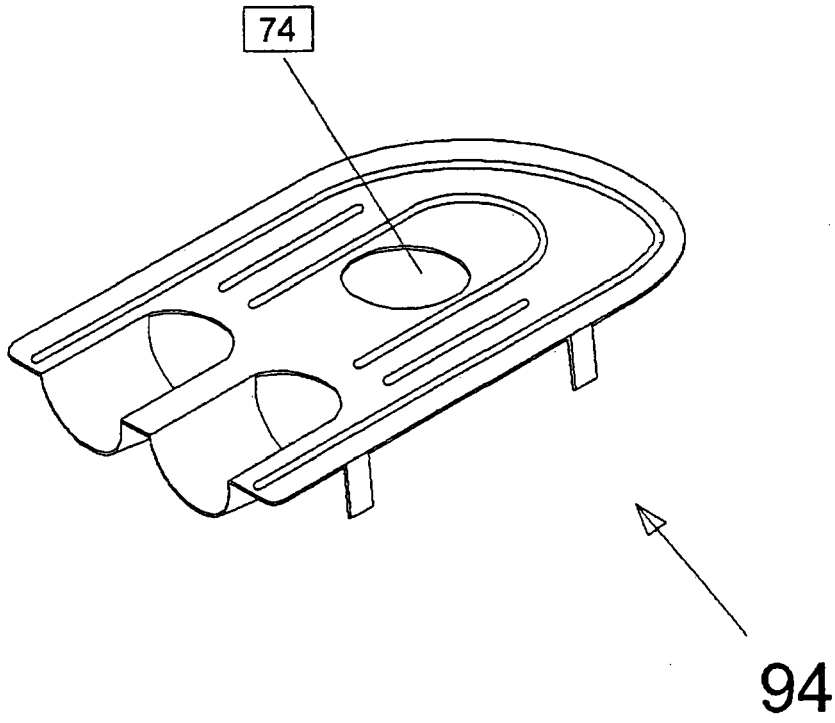
FIG. 9 is a perspective view of a stamped sheet metal insert for a roofing tile of the present invention.

An insert 94, different from insert 88, is depicted in FIG. 9. Insert 94 is most advantageously made of a stamped metal plate (such as stainless steel, galvanized iron, copper or tin) and is most advantageously set in a roofing tile of the present invention, such as roofing tile 78 depicted in FIG. 7. After the molding step of tile 78, a simultaneous step of defining holes 52 and installing insert 94 is made. After a hardening step, insert 94 is securely and virtually non-reversibly installed inside tile 78. This is exceptionally true when insert 94 is made of galvanized iron and tile 78 is made of concrete, as the coefficient of expansion of iron and concrete during heating is similar. The plug of material punched out to make hole 52 can be removed by poking the plug out using hole 96 in insert 94.

As seen in FIG. 7, on upper surface 50 of tile 78 there are found features such as parallel ridges 98, raised ridge 100, and depressions 102 designed to define channels to direct, to the proximity of holes 52, fluid flowing from the direction of top edge 44 towards bottom edge 46.

Figure 10:
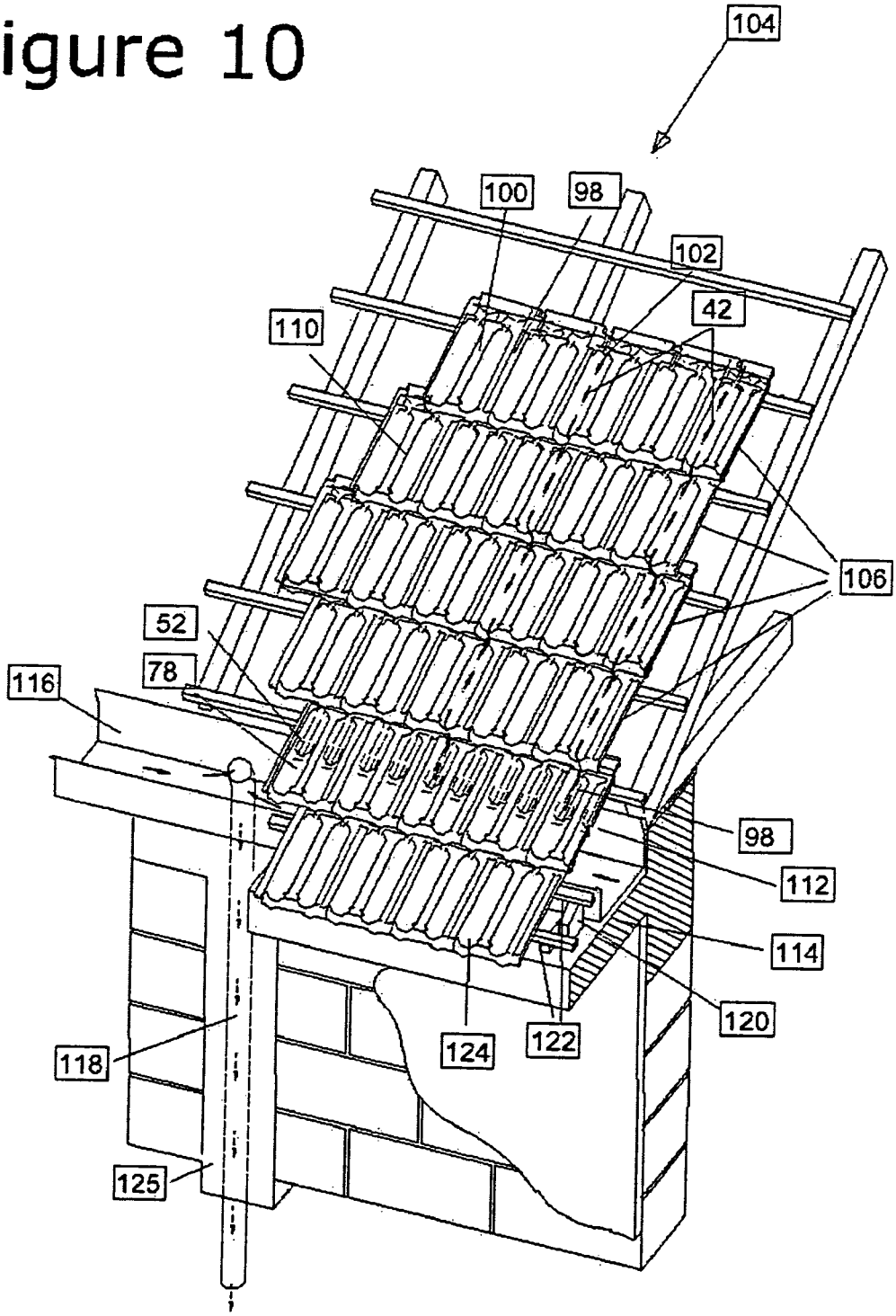
FIG. 10 is a perspective view of a roof of the present invention.

In FIG. 10, a section of a roof 104 showing four courses 106 of prior art roofing tiles 110 and one course 112 of roofing tiles 78 of the present invention, is depicted. Prior art roofing tiles 110 have substantially the same shape and dimensions as roofing tiles 78, with the exception that tiles 110 do not have holes 52. The interleaving allowed by grooves 80 and 84 and ridges 82 and 86 (FIG. 7) is clearly depicted. Precipitation falling on roof 104 is concentrated by the channels formed by parallel ridges 98, raised ridges 100, and depressions 102, and directed towards holes 52 in tiles 78 of course 112, as depicted for liquid flow 42.

The design of roofing tiles, whether for the definition of liquid-directing channels, for interleaving or for esthetics is a thousands year old art and needs not be discussed hereinfurther.

As discussed hereinabove, an advantage of using the roofing tiles of the present invention is that such use allows for a roof, superior to roofs known in the art, to be made. The use of the roofing tiles of the present invention allows a gutter to be hidden from view or within the building itself.

In principle, a roof constructed in accordance with the teachings of the present invention may have anywhere from one perforated roofing tile as described hereinabove to having all the roofing tiles of the roof be perforated as described hereinabove. Practically speaking, it is most advantageous to use only a limited numbers of perforated roofing tiles when constructing one roof. The number and arrangement of perforated roofing tiles used is preferably such that a significant percentage of the total tiled roof area ultimately drains to the roofing tiles of the present invention. One such preferred arrangement is to select one course of roofing tiles to consist substantially in its entirety of perforated roofing tiles as described hereinabove. Under this course of perforated roofing tiles is positioned a gutter so as to capture liquid flowing through the holes in the perforated roofing tiles. From the gutter the liquid is drained off into the gutter drainage system or, for example, to a water reservoir.

As is clear to one skilled in the art, once a roof is built with perforated roofing tiles, a gutter can be built within the building, rather than outside of it. A gutter found within a building is more robust and requires less maintenance. Such an internal gutter is advantageously constructed using poured concrete or prefabricated gutter sections, allowing the easy integration of a slope in the gutter to encourage effective liquid transport to the drainage system.

One embodiment of a roof of the present invention is depicted in FIG. 10. On poured concrete ledge 114 is placed a prefabricated gutter 116, made of water impermeable plastic, metal or such. Prefabricated gutter 116 is placed below holes 52 of tiles 78 of course 112 so that liquid 42 drops into gutter 116 after passing through holes 52. Liquid in gutter 116 flows out through downspout 118 to be transported away. On ledge 114, a wooden construct 120 including battens 122 is placed to allow the addition of a course 124 of prior art tiles that extends downwards beyond gutter 116. Gutter 116 is hidden behind course 124 and protected from the elements and from debris. Little gutter maintenance is required throughout the lifetime of roof 104. Since gutter 116 is protected by roof 104 and downspout 118 runs through concrete pillar 125, water in downspout 118 or gutter 116 does not freeze.

Figure 11:
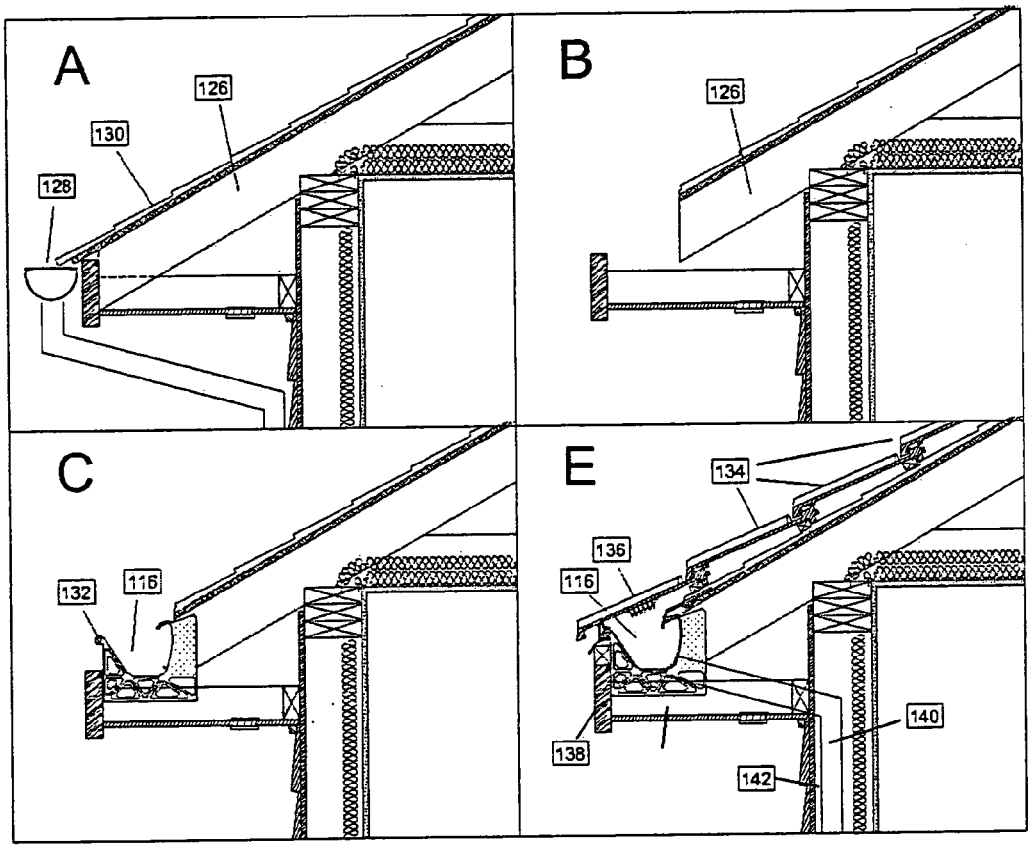
FIGS. 11A–11E are a side view of steps of converting a prior art roof to be a roof of the present invention.

In an additional embodiment of a roof of the present invention, depicted in FIG. 11, a prior art roof is converted to be a roof of the present invention.

In FIG. 11A a side view of a prior art roof 126 with an external gutter 128 and bitumen roofing tiles 130 is depicted.

As a first step, gutter 128 is removed and roof 126 is shortened, FIG. 11B.

Figure 11D:
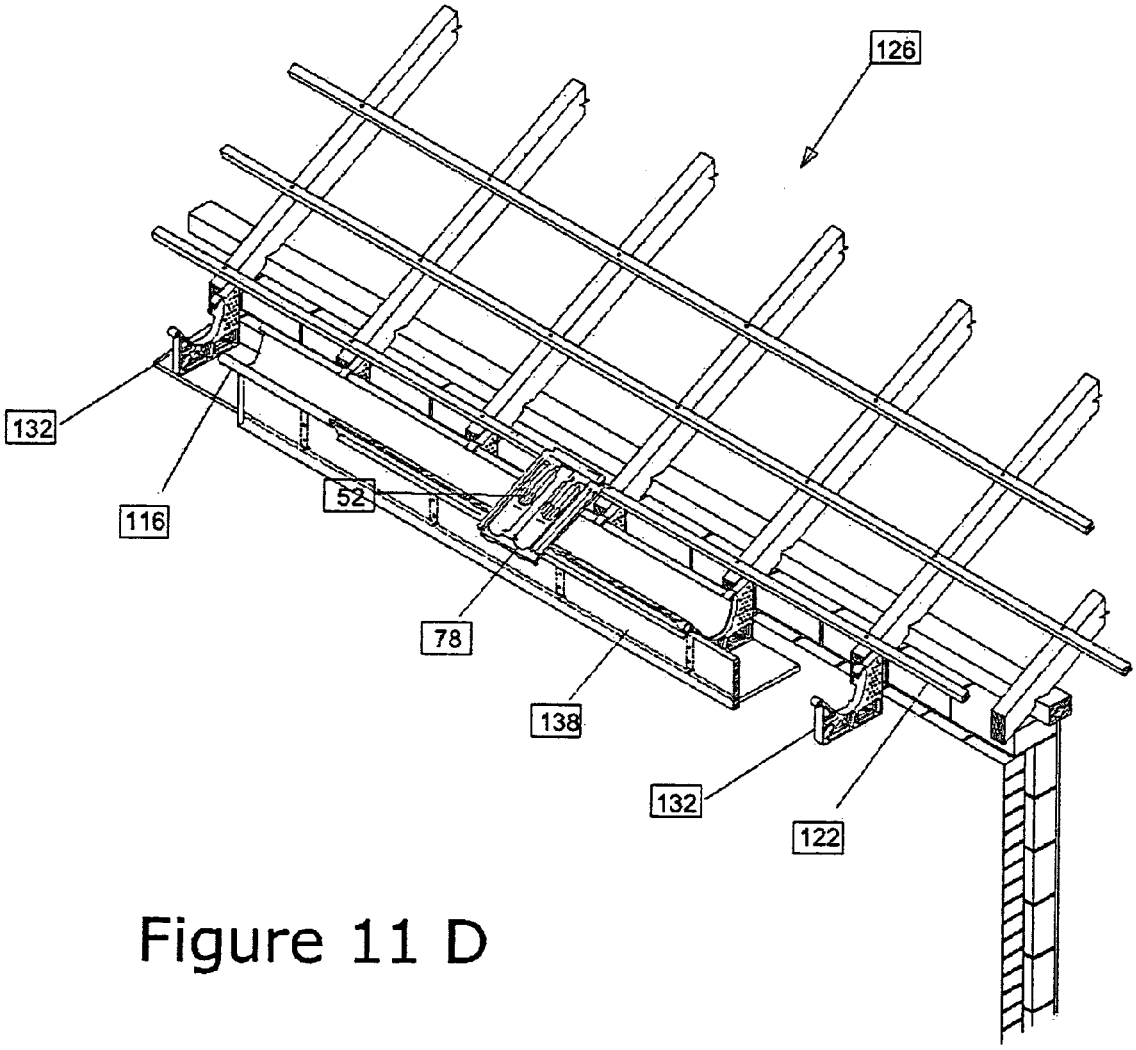

A prefabricated gutter 116 supported by hangers 132 is attached to the edge of roof 126, FIGS. 11C and 11D. In FIG. 1D, hangers 132 and sections of prefabricated gutter 116 are clearly seen. For illustrative purposes, a roofing tile 78 of the present invention is depicted resting on batten 122 in such a way that holes 52 are positioned over gutter 116.

Lastly, in FIG. 11E, roof 126, covered with three courses of prior art roofing tiles 134 and one course 136 of roofing tiles of the present invention is depicted. Wooden fascia 138 protects and conceals gutter 116. Downspout 140 is connected to gutter 116 and passed through wall 142 of the building on which roof 126 is built.

The advantages of a roof built using the roofing tiles of the present invention and otherwise in accordance with the teachings of the present invention are manifold. The roof is esthetic both due to the continuity of roof tiling and due to the fact that the gutters and associated drainage system is concealed from view. The filtering action of the roofing tiles of the present invention prevents solid objects such as tennis balls or leaves from entering the gutter and consequently the drainage system. Obstruction by solid objects is prevented and the necessity for maintenance is reduced. Water that enters the gutter and drainage system is relatively clean and is therefore suitable for long term storage in a reservoir for further use.

While the invention has been described with respect to a limited number of embodiments, it will be appreciated that many variations and modifications of the invention may be made.

The invention claimed is:

1. A roofing tile comprising:

a) an upper surface having a top edge and a bottom edge;

b) a lower surface c) at least one hole, defining a passage through which a liquid flowing on said upper surface in a direction from said top edge toward said bottom edge may pass; and d) at least one insert deployed in said hole, said insert configured with at least one protrusion extending below said lower surface so as to guide said liquid through said hole and cause said liquid to fall from the tile.

2. The roofing tile of claim 1, wherein said insert is irreversibly attached to the tile.

3. The roofing tile of claim 1, wherein said at least one protrusion is configured as a plurality of curved ribs and straight ribs, such that said straight ribs are substantially parallel to said direction of flow of said liquid and curved ribs are deployed at an angle to said direction of flow of said liquid, and said curved ribs extend below said lower surface.

4. The roofing tile of claim 1, wherein said upper surface includes at least one channel configured to direct said liquid to said hole.

5. The roofing tile of claim 4, wherein said channel includes a plurality of parallel ridges.

6. The roofing tile of claim 1, where said top edge and said bottom edge are configured such that the tile is deployable in any course other than a first course of tiles deployed on a roof.

7. The roofing tile of claim 1, wherein the tile is configured from concrete and said insert is configured from galvanized iron sheet metal.

* * * * *